US006780068B2

(12) United States Patent
Bartholoma et al.

(10) Patent No.: US 6,780,068 B2
(45) Date of Patent: Aug. 24, 2004

(54) PLUG-IN CONNECTOR WITH A BUSHING

(75) Inventors: Mario Bartholoma, Winden (DE); Achim Hoch, Waldkirch (DE); Herbert Bohusch, Winden (DE)

(73) Assignee: Anton Hummel Verwaltungs GmbH, Waldkirch (DE)

( * ) Notice: Subject to any disclaimer, the term of this patent is extended or adjusted under 35 U.S.C. 154(b) by 34 days.

(21) Appl. No.: 10/257,696

(22) PCT Filed: Mar. 17, 2001

(86) PCT No.: PCT/EP01/03073

§ 371 (c)(1),
(2), (4) Date: Nov. 26, 2002

(87) PCT Pub. No.: WO01/80372

PCT Pub. Date: Oct. 25, 2001

(65) Prior Publication Data

US 2004/0038596 A1 Feb. 26, 2004

(30) Foreign Application Priority Data

Apr. 15, 2000 (DE) ..... 200 07 001 U

(51) Int. Cl.[7] ..... H01R 13/514
(52) U.S. Cl. ..... 439/752; 439/95
(58) Field of Search ..... 439/752, 95, 924.1, 439/660

(56) References Cited

U.S. PATENT DOCUMENTS 3,177,464 A 4/1965 Solorow et al.
5,503,569 A 4/1996 Huss, Jr. et al.
6,132,230 A * 10/2000 Shinozaki et al. ..... 439/281
6,527,583 B2 * 3/2003 Plate ..... 439/489

FOREIGN PATENT DOCUMENTS

| | | |
|---|---|---|
| DE | 4006309 | 9/1991 |
| DE | 9316725 | 1/1994 |
| DE | 4106714 | 12/1996 |
| DE | 29719217 | 4/1998 |
| EP | 0475414 | 3/1992 |
| FR | 1547023 | 11/1968 |
| GB | 1526616 | 9/1978 |

* cited by examiner

*Primary Examiner*—P. Austin Bradley
*Assistant Examiner*—X. Chung-Trans
(74) *Attorney, Agent, or Firm*—Volpe and Koenig, P.C.

(57) ABSTRACT

A plug-in connector has an insulating body which holds electrical contacts, for example contact pins or contact tubes, in bores which extend in the axial direction. On its outside, the insulating body has a groove which opens outwardly and which intersects the holes or bores for the contacts over part of their radial extension. A retaining ring fits into the groove and in the working position, simultaneously engages in groove-like recesses provided on the contacts, thereby fixing the contacts in an axial direction. The retaining ring can also support at least one retaining tongue protruding preferably radially inwardly in the plane of the retaining ring. The retaining tongue extends into the area of a further bore for a middle contact through a channel or opening in the insulating body and in the working position, engages in the recess thereof so that this middle contact is also axially fixed.

18 Claims, 5 Drawing Sheets

Fig. 9
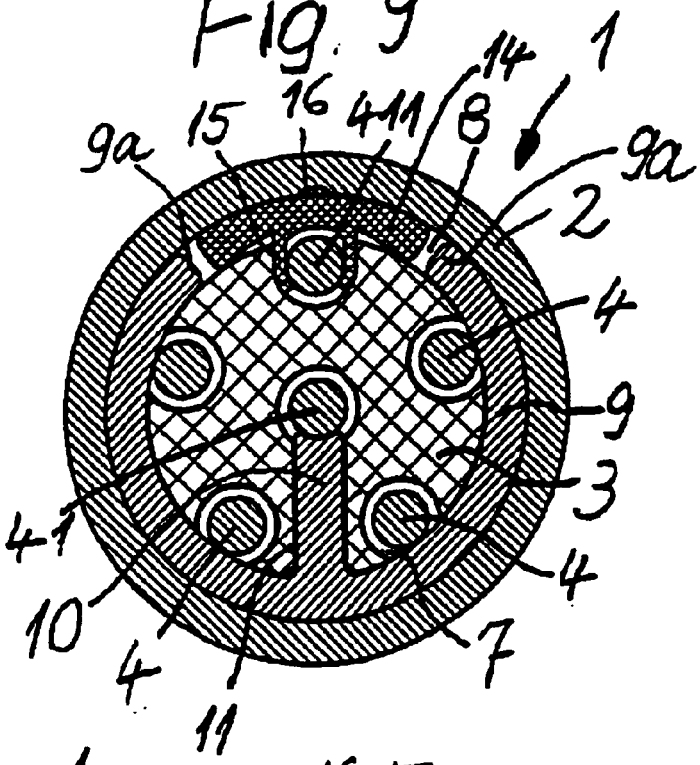
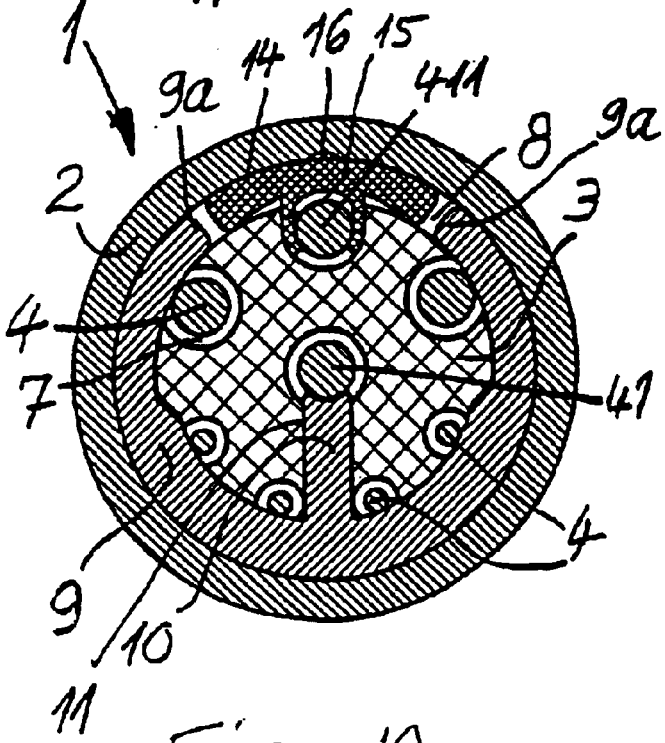
Fig. 10

PLUG-IN CONNECTOR WITH A BUSHING

BACKGROUND

The invention relates to a plug-in connector with a bushing and with an insulating member arranged in the bushing in the use position, and with elongate, pin-like contacts—contact pins or female contacts—which in the use position are fixed in holes or bores which receive them in the insulating body via projections which engage in groove-like recesses located on the contacts transverse to their length direction. The holes or bores are located with the elongate contacts on an imaginary cylinder concentric to the middle of the bushing or of the insulating member and thus at the same distance from the inner side of the bushing or of the surface of the insulating member. A further contact in the interior of the imaginary cylinder is arranged within a hole or bore and parallel to the other contacts.

Such electrical plug-in connectors are known and have proved to be useful, since the contacts are fixed and retained in the axial direction when the plug-in connector is plugged together with, or released from, a counterpart, which is frequently associated with overcoming clamping forces and consequent exposure of the contacts to a force in their length direction.

The mutual allocation of the projections to the recesses on the plug contacts has heretofore been costly. In many cases the insulating member is formed in a plurality of parts in order to be able to fix the contacts with their recesses to corresponding projections within the insulating member when this is dismantled. This means that it subsequently has to be assembled, so that both production and assembly are to be considered as costly;

Another known solution provides projections, produced integrally with the insulating member, which, when the pin-like contacts are pushed in, at first deflect and then can latch in the recesses on the contacts. This requires a correspondingly elastic material and furthermore expensive molds for the production of such an insulating member.

SUMMARY

The invention has as its object to provide an electrical plug-in connector of the kind noted above, which is easy to produce and which, with a one-piece constitution of the insulating member, makes it possible in a simple manner to fix the contacts, whether they are contact pins or female contacts, via recesses and projections engaging therein.

To attain this object, the plug-in contact as noted above further comprises the insulating member having at least one groove, running around its outside and open outward, and intersecting or passing through the holes or bores for the contacts over a portion of their radial extent on their side facing the outside of the insulating member; and in that the groove is arranged on the insulating member at the height at which the recesses of the contacts are located in the use position. A latching or retaining ring is provided, formed of an insulating material and extending at least over a portion of the entire periphery of the insulating member, fitting into the groove of the insulating member and simultaneously engaging in the use position as a projection into the recesses of the contacts. The retaining ring bears at least one inwardly-projecting retaining tongue which in the use position engages into a channel or perforation extending inward from the groove and projects to within the recess of a further contact located in the interior of the imaginary cylinder and its receiving hole or bore.

An integral, one-piece insulating member can be provided in this manner in which corresponding holes or bores are arranged into which the pin-like contacts are to be pushed, the projections fixing these contacts in the axial direction being formed from a common retaining ring, which is located along a groove of the insulating member and intersects or slightly passes through the holes or bores of the contacts, so that the retaining ring located in this groove can engage in the recesses, located at the same height, of the contacts. A multi-part insulating member, or expensive injected projections on the insulating member for axial fixing of the contacts, is thereby avoided.

It is favorable for easy assembly if the retaining ring comprises only a portion of a circle and its two free ends can be moved apart as least so far that their spacing in this deformed state corresponds to the diameter of the insulating member in the region of the floor of the groove. Thus the retaining ring is interrupted and has two free ends, and can be bent such that in spite of its function of enclosing the insulating member in the groove in the use position, it can first be pushed-on from the side. The retaining ring, which can be bent outwardly due to its elasticity, then snaps back into the use position in the groove due to its elasticity and the resulting restoring force and is thereby fixed. At the same time, its elasticity enables it to move slightly aside again when the contacts are pushed into their holes, into which the retaining ring slightly engages.

It is appropriate here if the groove-like recesses on the elongate contacts or contact pins, particularly groove-like recesses running around their circumference, are respectively bounded by a collar or the like, radially outstanding with respect to the contact region, and on the side remote from the recess this collar has a bevel or a cone shape which, on insertion of the contact into its bore, runs on against the retaining ring and deflects this radially until the recess of the contact is in coincidence with the groove of the insulating member, so that the retaining ring then automatically drops into the recess of the contact and thus fixes the contact axially. It follows from this that the contact region proper of the contact has a smaller cross section than this collar and the portion of the contact extending toward the other side.

One of the contacts arranged on an imaginary cylinder can be provided as a grounding contact and left free by the retaining ring, and this grounding contact can be fixed in the axial direction by an electrically conductive retaining spring or the like fitting into the groove of the insulating member and engaging the contact there, particularly gripping and latching the contact with spring arms or the like. This arrangement is advantageous from many aspects, since such plug-in connectors as a rule require a grounding contact. The presence of this grounding contact is used so that the retaining ring has to run only over a portion of the periphery of the insulating member, and thus has to bend outward a correspondingly small amount during assembly, which reduces or avoids the risk of breakage of the retaining ring when mounting it. At the same time an appropriate solution results for the fastening of the grounding contact, in which the presence of the groove running around the insulating member can be correspondingly used. The retaining ring of the grounding contact, namely a retaining spring, can also likewise form the grounding contact connection.

This results in all in an arrangement in which not only easy production, but also a very easy and nevertheless effective assembly are made possible, in that the retaining ring is first placed on the insulating member in its groove, and then the contacts are pushed in the axial direction into the holes or bores such that their own contact regions are situated to the front in the direction of insertion. With their conical region or projection, they then displace the retaining ring, which then however automatically falls into its recess again and thus effects the fastening. Since the retaining ring is resiliently elastic, it can move aside until, during axial insertion, the recess of the contact reaches this region, and the retaining ring can then spring back again. Due to the elasticity of the retaining ring, the contact pins are thus already secured after insertion, and this also holds for a contact pin in an inner position, which engages with a corresponding conical projection or region on the radially inward-facing tongue of the retaining ring and can displace this radially outward, which is likewise possible due to the elasticity of the retaining ring.

In the use position, the free ends of the retaining ring are then arranged on both sides of the grounding contact and spaced apart from this. The inward-projecting retaining tongue, penetrating a corresponding opening or channel of the insulating, member makes sure of the exact and correct positioning of the retaining ring.

In the final use position, the retaining ring is then secured, by the bushing which receives the insulating member, and which as a rule forms the plug housing, against an undesired bending up.

The retaining spring for the grounding contact can be formed of metal or of electrically conductive plastic, and can have on its outside a bead or projection, in particular, which in the use position protrudes over the surface of the insulating member at least by the play of the insulating member with respect to the bushing and/or the play of the retaining spring in the groove of the insulating member. Electrically conductive plastic can here also be a plastic which is coated or vapor-deposited with metal on the outside. The retaining spring, by means of the bead or projection, also projects slightly in the use position over the surface of the insulating member, so that in each case there results an electrical clamping contact for the grounding contact to the bushing, which as a rule is metallic, so that further measures for connecting the grounding contact are not necessary. Thus the groove arranged on the insulating member is found to be advantageous, since besides receiving the retaining ring, it also receives the retaining spring for the grounding contact in a simple manner and can keep it in contact with the outer bushing.

The cross section of the retaining ring almost fills the cross section of the groove in the use position, or at least the radial extent or width of the retaining ring can correspond to that of the groove, and the bushing receiving the insulating member can accordingly fix the use position of the retaining ring. In practice, the outer circumferential side of the retaining ring forms in this manner an extension of the outer surface of the insulating member; that is, the retaining ring can be about flush with the surface of the insulating member in the use position.

The already mentioned retaining tongue of the retaining ring, projecting radially inward, can be of a concave shape at its end and thereby can be at least partially adapted to the circumferential shape at the base of the recess of the contact to be held by it. The end of the retaining tongue can thus receive a concave curvature which corresponds to the radius of the contact within its recess, so that as large as possible a contact surface results between the retaining tongue and this contact, and the contact is partially encompassed by this retaining tongue. The region of the retaining tongue which engages in the recess of the contact and ensures axial fixing is also correspondingly large.

The retaining ring can extend around more than 180° of the insulating member within the groove which runs around the latter, preferably about the whole circumference. Since the retaining ring does not have to extend over the whole circumference, the groove also does not necessarily need to run all the way around; however, this is appropriate and simpler for manufacture. The retaining ring which extends around more than 180° permits the already mentioned automatic fixing on the insulating member before the outer bushing encloses the arrangement and prevents and locks the retaining ring from coming out of the groove. However, it is also conceivable to assemble the retaining ring from pieces, which are clamped into the groove and are finally fixed by the bushing.

The free ends of the one-piece retaining ring can be mutually beveled so that they form an insertion funnel for facilitating pushing onto or pushing into the groove of the insulating member. This further facilitates assembly.

The bushing enclosing the insulating member can be formed of metal and form the housing of the plug-in connector, and can if necessary have a thread on its outside. This bushing then receives, in a known manner, a corresponding additional function in that on the one hand it fixes in its interior the insulating member and the retaining ring, and thereby also the contacts, and on the other hand cooperates with the grounding contact and, as a mounting part, can be screwed into a housing or a grip portion or the like.

The bushing can have positioning projections or recesses on its inner side and the insulating member can have deformations fitting together therewith, setting the preselected rotation position of the insulating member when it is axially inserted. The contact pins thereby simultaneously receive their exact positioning relative to the bushing.

An undercut in the axial direction can be provided in the interior of the bushing, behind which undercut there fits at least one retaining tongue which protrudes on the insulating member in the radial direction, and is radially yieldable or can be pressed in. If the insulating member is axially introduced into the bushing, such a retaining tongue automatically fixes the axial position and no further measures are necessary for the axial fixation of the insulating member within the bushing, although they would be possible additionally. In any case, the axial position of the insulating member within the bushing is predetermined and established.

The retaining tongues, elastically resilient or deformable in the radial direction, can here be pivotable about a pivot axis parallel to the mid-axis of the insulating member or of the plug-in connector, and can extend in the circumferential direction of the insulating member. Retaining tongues are frequently known which extend in the axial or plug-in direction and are pivotable around corresponding axes which run transversely. By an arrangement of the retaining tongues somewhat in the circumferential direction, they can be given a relatively long length as well as width, and thereby produce a large-surface connection to the interior behind the undercut of the bushing.

The elastically deformable retaining tongue can border on the groove with a side surface, and can bound the groove, and the retaining ring or the retaining spring can block the elastically yieldable retaining tongue against an axial deformation. Since the retaining tongue is yieldable in the radial direction, a certain axial deformation by corresponding forces is not completely to be excluded, which however is prevented in an advantageous manner by the retaining ring or the retaining spring in the groove of the insulating member. The retaining ring thereby receives a further function.

The retaining tongue can have a latching projection on its outer side, the radial extent of which is equal to or smaller than the deformation path of the retaining tongue in the radial direction. This projection, when pushed into the bushing, springs behind the already mentioned undercut and ensures axial fixation.

It should be mentioned that the width of the retaining ring, and thus its radial dimension, is adapted to the radial distance of the outward-facing surface of a contact or contact pin from the outside of the insulating member, and that the width of the retaining ring in the region of thin contact pins or female contacts is greater than in the region of thicker contact pins or female contacts. The retaining ring can thus be differently shaped in its circumference as regards its width, and adapted to the degree to which the respective contact is distant, due to its own dimension, from the outer surface of the insulating member.

In all, a plug-in electrical connector results in which an insulating member made in one piece can receive a large number of the contact pins, and these can be fixed in the axial direction by a common retaining ring, although at least one of the contacts is arranged within an imaginary cylinder. The basic form of the insulating member is simple, since no projections integrally formed on it are required for defining the contacts. The individually used parts can easily be produced and the whole assembly can likewise be performed simply and rapidly, and nevertheless effectively, and makes sure of an exact location of the individual contacts within the plug-in connector housing and relative to each other.

BRIEF DESCRIPTION OF THE DRAWINGS

Preferred embodiments of the invention are described in detail hereinafter, using the accompanying drawings. In the drawings:

FIG. 9 is a cross section corresponding to FIG. 8 after the insertion of the insulating member provided with contacts into the bushing.

FIG. 10 is a cross section corresponding to FIG. 9 through a plug-in connector with eight contacts, four contacts having a smaller cross-section and diameter than the remaining contacts and than the contacts according to FIG. 9, and the retaining ring accordingly having regions differing as regards their width.

DETAILED DESCRIPTION OF THE PREFERRED EMBODIMENTS

Figure 1:
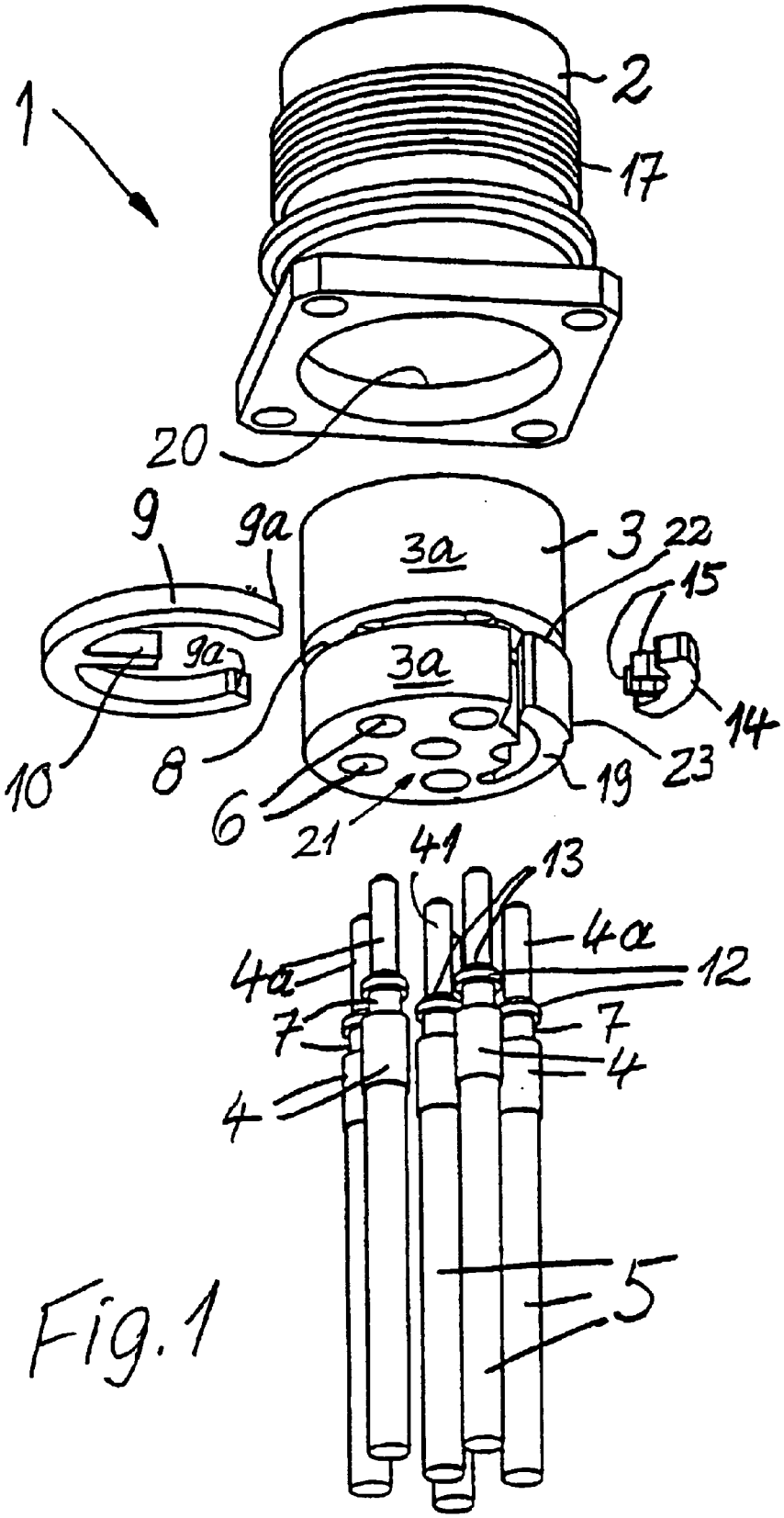
FIG. 1 is an exploded perspective side view of the individual parts of a plug-in connector according to the invention before assembly and mounting.

In the preferred embodiments described hereinafter of an electrical plug-in connector 1, portions which correspond in their function are given corresponding reference numerals, even if having a somewhat modified design.

Figure 2:
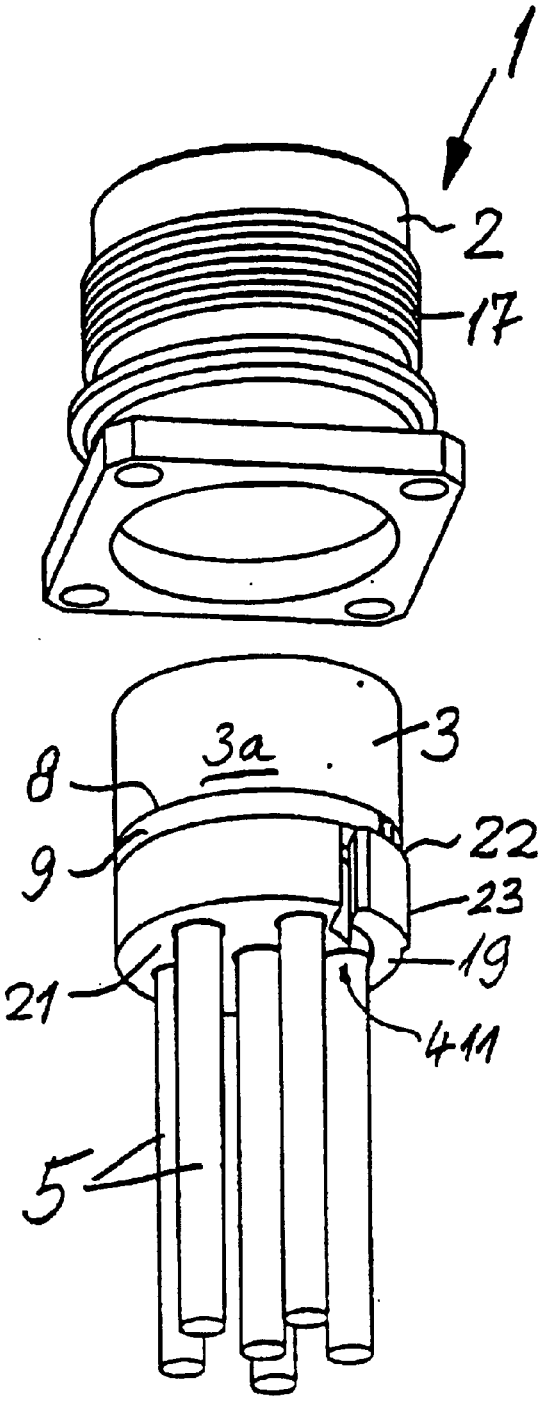
FIG. 2 is a view corresponding to FIG. 1 after the assembly of the contacts, provided in this case as pins, with the insulating member before its insertion into the bushing serving as a housing.
Figure 3:
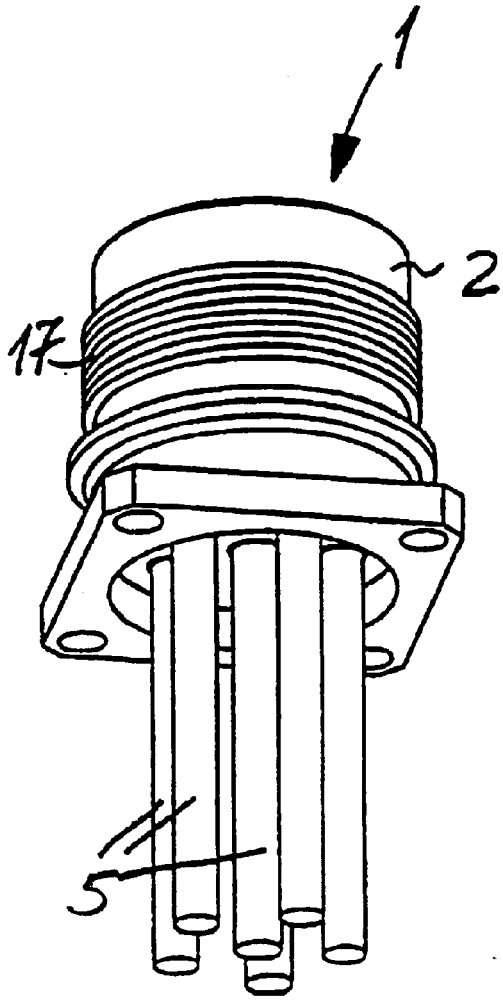
FIG. 3 is a view showing the final mounting of the plug-in connector, after the introduction of the insulating member, provided with contacts, into the bushing.
Figure 4:
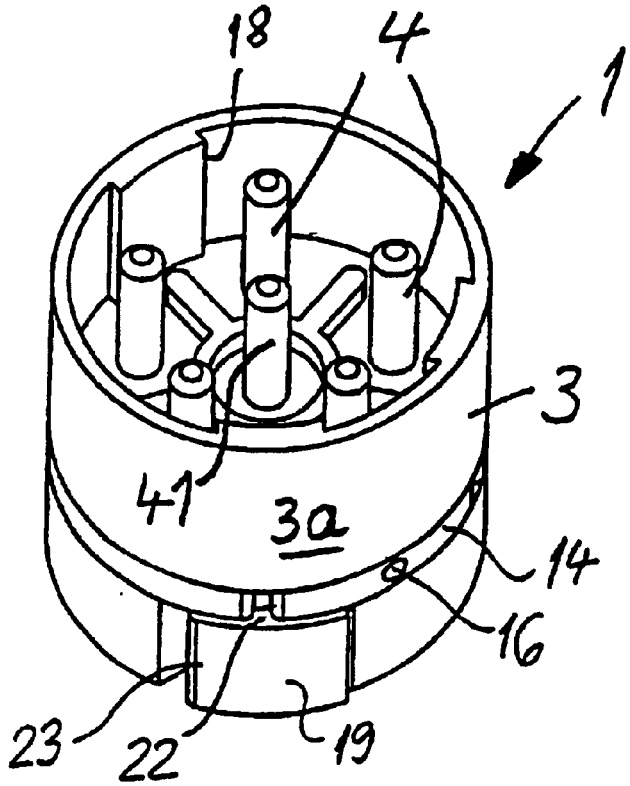
FIG. 4 is a perspective top view of the insulating member provided in this case with contacts formed as pins, still without the bushing forming the plug-in connector housing.
Figure 5:
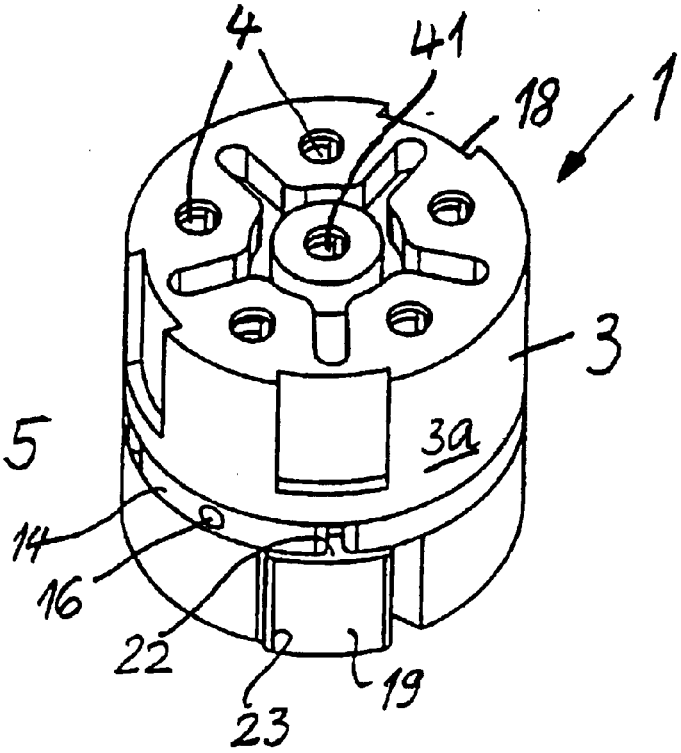
FIG. 5 is a modified embodiment corresponding to FIG. 4, in which the insulating member has a modified construction with respect to FIG. 4 for receiving the contacts provided as sockets, but formed for delimiting the contacts in the same manner as in the embodiment examples according to FIGS. 1–4.

The plug-in connector 1 shown in FIG. 3 in its final state and in FIGS. 1 and 2 in individual parts, has a bushing 2 forming its housing and an insulating member 3 arranged and fixed in this bushing 2 in the use position, and also elongate, pin-like contacts 4, which can be contact pins according to FIGS. 1–4 and 6–10, and female contacts according to FIG. 5, for which the corresponding connector thus has pins.

Cables or stranded conductors 5 are connected, for example soldered, to these contacts 4 before or after assembly; according to FIGS. 1–3, before assembly.

The insulating member 3 contains holes or bores 6 in which the contacts 4 are fixed, in a manner yet to be described, by means of projections which engage in groove-like recesses 7 on, and transverse of the extension direction of, the contacts 4. The holes or bores 6 are situated, with the elongate or pin-like contacts 4 according to FIGS. 4 and 5, or also according to FIGS. 9 and 10, about on an imaginary cylinder concentric of the middle of the bushing 2 or of the insulating member 3, and thus at the same distance from the inner side of the bushing 2 or the outer or upper surface of the insulating member 3. In all the preferred embodiments, it can furthermore be seen that a further contact 41 is arranged in the interior of the imaginary cylinder, parallel to the other contacts 4, within a hole or bore 6.

For the axial fixing of the contacts 4 and 41 within the insulating member 3, a groove 8 that opens outwardly is provided, extending along an outer surface 3*a*. The groove 8 intersects the holes or bores 6 for the contacts 4 over a portion of their radial extent on their side facing the outer surface 3*a* of the insulating member 3. This can be seen, for example, in FIG. 1 and indirectly in FIGS. 7–10.

This groove 8 is arranged on the insulating member 3 at the height or axial distance from its ends at which the recesses 7 of the contacts 4 are situated in the use position, so that the groove 8, after the insertion of the contacts 4 into their use position, in practice continues into their groove-like recesses 7.

The plug-in connector 1 further includes a latching or retaining ring 9 formed of an insulating material, extending over at least a portion of the whole circumference of the insulating member 3, and fitting into the groove 8 of the insulating member 3, and in the use position according to FIGS. 7–10, engaging in the recesses 7 of the contacts 4 at the same time that projection which axially fixes these in their use position.

So that this retaining ring 9 can fix in the axial direction, not only the contacts 4 arranged on the imaginary cylinder, but also in the same manner the contact 41 located in the interior, the retaining ring 9 in the first preferred embodiment is provided with one (with plural inner contacts, more could possibly be provided) inwardly-projecting retaining tongue 10 which is integrally connected to it and in the use position engages in a channel or perforation 11 extending inwardly from the groove 8 (see FIGS. 7–10) and protruding as far as into the recess 7 of the further contact 41 located in the interior of the imaginary cylinder and the hole or bore 6 which receives it. Thus the retaining ring 9 with the aid of this retaining tongue 10 can fix in the axial direction, not only the contacts 4 situated on a common cylinder, but also a further contact 41 located therebetween, so that no latching projections on the insulating member 3 itself are required for such axial fixing, nor would the insulating member 3 have to be divided into multiple pieces.

Figure 8:
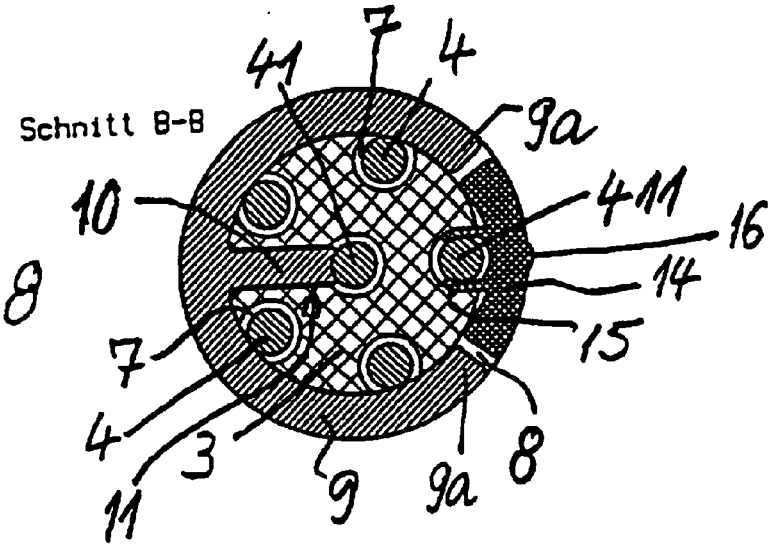
FIG. 8 is a cross section, taken along the line B—B in FIG. 7, passing through the retaining ring runs which delimit the contacts in the axial direction, of the insulating member equipped with contacts.
Figure 7:
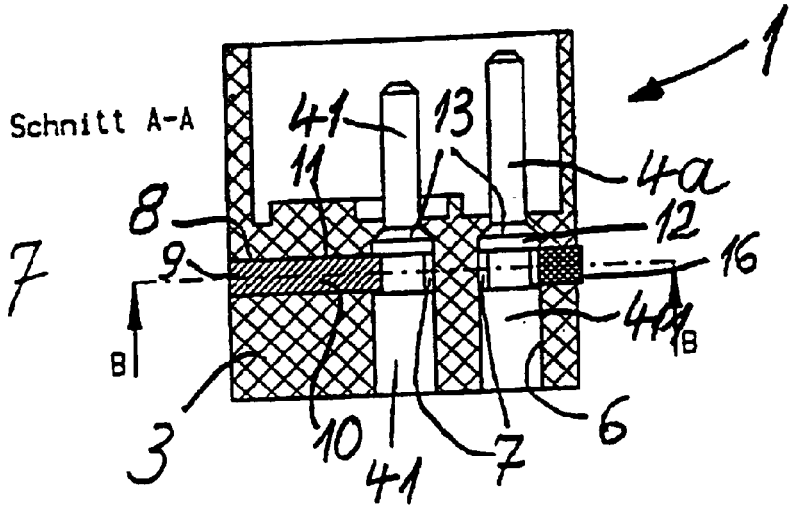
FIG. 7 is a longitudinal section, taken along the line A—A in FIG. 6, of the insulating member with contacts formed as pins fastened thereon.
Figure 6:
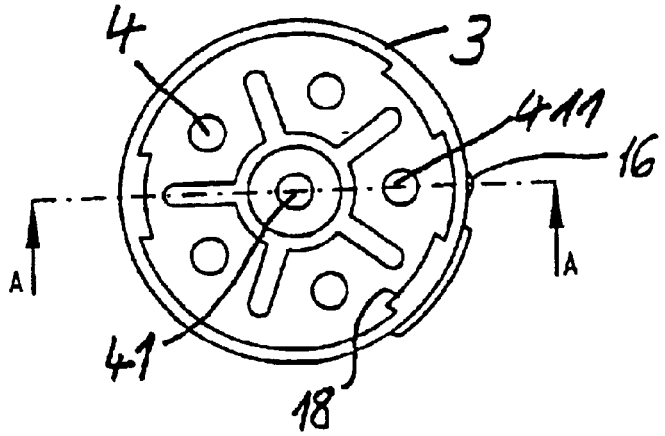
FIG. 6 is a top view of the insulating member shown in FIG. 4 in perspective.

Here it can be seen in several Figures, particularly clearly in FIG. 1 and also in FIGS. 8–10, that the retaining ring 9 runs only over a partial circle and its two free ends 9*a* can thus be elastically bent apart far enough for their spacing in this deformed state corresponds to the diameter of the insulating member 3 in the region of the base of the groove 8. This deformed or bent state of the retaining ring 9 is not shown; however it is easily imaginable, for example from FIG. 8. It is favorable here that the retaining tongue 10 is located practically in the middle between the free ends 9*a* of the retaining ring 9 and moreover in the same plane as the course of the rest of the ring, so that in practice it is formed on the neutral zone when the retaining ring 9 is bent.

The groove-like recesses 7 located on the contacts 4 and 41 extend completely around their circumference in the preferred embodiments, so that the rotational position of the contacts 4 and 41 can be arbitrary during their assembly. These recesses 7 are respectively bounded by a collar 12 radially outstanding with respect to the contact region 4*a*, and this collar 12 has, on the side remote from the recess 7, a bevel or a cone 13 which during insertion of the respective contact 4 or 41 into its bore 6 against the retaining ring 9 then already present in the groove 8, runs on and deflects this retaining ring 9 radially outwardly until the recess 7 of the contact 4 or 41 coincides with the groove 8 of the insulating member 3, so that the retaining ring 9 then automatically falls into the recess 7 of the contact 4 or 41. Thus a very simple assembly of the contacts 4 within the insulating member 3 results, in which firstly the retaining ring 9 is inserted, after which the contacts 4 can easily be pushed into their bores 6, in order to form with the retaining ring 9 an axial snap connection.

In the preferred embodiment, a contact arranged on an imaginary cylinder is provided as the grounding contact 411 and according to FIGS. 7–10 is left free by the retaining ring 9. This grounding contact 411 can be fixed in the axial direction by an electrically conducting retaining spring fitting into the groove 8 which preferably runs around the whole circumference of the insulating member 3, gripping the grounding contact, engaging in the use position into the recess 7 on the grounding contact 411 and in particular latching with spring arms 15. This retaining spring 14 thus fixes the grounding contact 411 in the axial direction in an analogous manner to that of the retaining ring 9 with the other contacts 4 and 41, in that use is made of the intersection of the groove 8 running around the insulating member 3 with the bore 6 for the respective contact and thereby also the grounding contact 411, making possible the corresponding engagement into the recess 7 of this grounding contact 411.

For example, it can be seen using FIGS. 8–10 that the free ends 9*a* of the retaining ring 9 are arranged in the use position on both sides of the grounding contact 411 and spaced apart from this, that is, the grounding contact 411 is provided where the spacing between the two free ends 9*a* of the retaining ring 9 is located. Since the grounding contact has its own fastening, this is favorable for the overall arrangement and for assembly.

The retaining spring 14 for the grounding contact 411 is formed of metal or electrically conductive plastic and according to FIGS. 4, 5 and 8–10, and has on its outside a bead or projection 16 which in the use position projects above the surface of the insulating member 3. Preferably, this extends, in fact, at least by the play of the insulating member 3, with respect to the bushing 2 and also the play of the retaining spring 14 in the groove 8 of the insulating member 3. This projection 16 is thus shaped and dimensioned such that it abuts, under a given pressure in each case in the assembled position, on the bushing 2 which consists of metal or electrically conductive plastic, and thus produces an electrical connection for grounding.

In the use position, the retaining ring 9 fills the groove 8 at least with its width, but can if necessary also generally fill the groove 8 with its whole cross section and thereby be securely retained in its use position. Thus, according to FIG. 7, its outer circumference ends flush with the outside or surface 3*a* of the insulating member 3, so that the bushing 2 receiving the insulating member 3 and according to FIGS. 9 and 10 abutting in the use position on the outer surface 3*a* of the insulating member 3, automatically establishes the use position of the retaining ring 9. If the insulating member 3 with the contacts 4, 41 and 411 is pushed into the bushing 2, all the parts serving to fix the contacts 4 are in their turn automatically locked against inadvertent opening.

As indicated in FIG. 1, and easily seen in FIGS. 8–10, the retaining tongue 10, protruding radially inward from the middle of the circumference of the retaining ring 9 and in its plane, is of concave shape at its end and is thereby adapted to the circumferential shape of the further contact 41 to be retained by it at the base of its recess 7. The retaining tongue 10, due to its concave shape, encloses the further contact 41 at the base of its recess 7 over a given circumferential region, resulting in a flat contact and a corresponding large-surface engagement region in the recess 7, and thereby a good axial fixation.

The retaining ring 9 forms only a portion of a circular ring, but surrounds more than 180° of the insulating member 3 within the groove 8 which, in this embodiment, extends around the whole circumference, so that after insertion into the groove 8 and the resulting bending, the retaining ring 9 in the use position also non-positively covers the base of the groove 8. There thus already results from this shape and design a relatively secure fastening of the contacts 4 and 41, so that according to FIG. 2 the contacts 4 and 41 can first be connected with the insulating member 3 having the retaining ring 9, after which this unit, consisting of the insulating member 3 and contacts 4, 41 and 411, can be pushed into the bushing 2 and the assembly can thus be completed. The free ends 9*a* of the retaining ring 9 are beveled with respect to each other (in the embodiment example, provided with a somewhat radial course), such that they form an insertion funnel facilitating pushing the insulating member 3 onto or into the groove 8 of the insulating member 3.

The bushing 2 surrounding the insulating member 3 in the use position appropriately is made of metal, but if necessary of another relatively hard and strong, at least locally electrically conducting, material and forms the housing of the plug-in connector 1. In the preferred embodiment, it has a thread 17 on its outer side, so that it can be screwed into a corresponding counterpart.

The bushing 2 can have on its inside positioning projections or positioning recesses, not shown in detail in the embodiment shown, and the insulating member 3 can then have deformations 18 fitting with these, i.e., projections fitting together with recesses or recesses fitting together with projections, which on axial insertion of the insulating member 3 establish its preselected rotational position, so that the contacts 4, 41 and 411 later obtain a predetermined orientation and positioning. Corresponding deformations 18 on the insulating member 3 are indicated in FIGS. 4 and 5.

A region is furthermore provided in the interior of the bushing and arranged behind an undercut, effective in the axial direction, behind which a portion of the insulating member 3 is arranged in the use position and is secured against axial displacements. Seen in the plug-in direction, there fits behind this undercut (not shown in detail) a retaining tongue 19 which protrudes in the radial direction on the insulating member 3, is radially yieldable or can be pressed in, is resiliently elastically pivotable, as can clearly be seen in FIGS. 1 and 2, and is furthermore shown in FIGS. 4 and 5, the position of the undercut within the bushing 2 also being at the same time shown and indicated. The forward boundary 20 of this region of the undercut, seen in the plug-in direction, can be seen in FIG. 1, and behind it the bushing 3 somewhat enlarges again in the interior; this region corresponds in the axial direction to the axial width of the retaining tongue 19, so that after the insulating member 3 is placed into the bushing 2, the retaining tongue 19, further explained hereinafter, is positively retained in the axial direction between this outer boundary 20 and an analogous inner boundary.

The retaining tongue 19, elastically yieldable or deformable in the radial direction, in the embodiment example is pivotable, due to elastic deformation of the material, around a pivot axis running parallel to the mid-axis of the insulating member 3 or of the plug-in connector 1, and extends according to FIG. 1 in the circumferential direction of the insulating member 3. Here this elastically deformable retaining tongue 19 borders, with its side face 22 remote from the lower end 21 of the insulating member 3, on the groove 8, and also borders on this groove 8 over the circumferential region over which this retaining tongue 19 extends. It is thereby possible that the retaining ring 9 or the retaining spring 14 (in the embodiment according to FIGS. 4 and 5, both parts respectively as one part) at the same time lock the elastically resilient retaining tongue 19 in the use position against an axial deformation which would be possible when the insulating member 3 were loaded in the axial direction with respect to the bushing 2, for example via the contacts 4, which can for example occur on plugging the plug-in connector 1 together with a counterpart, or when pulling them apart. Since the retaining tongue 19 is elastic for latching, it could also be deflected axially by such axial loading, in addition to its radial deformation, but this is prevented by the described measures. The retaining ring 9 and/or the retaining spring 14 thus receive an additional function of axial securement of the insulating member 3 with respect to the bushing 2.

The retaining tongue 19 has on its outer side a retaining projection 23 whose radial extent is equal to or smaller than the deformation path of the retaining tongue 19 when this is pressed in radially, so that this retaining protrusion 23 admittedly allows the retaining tongue 19 to move into the interior of the cover member of the insulating member 3 due to pressing in, in order to make pushing into the bushing 2 possible, but then protrudes in the use position over the outer contour of the insulating member 3 in order to effect the latching with the undercut region behind the boundary 20 and thus to effect axial fixation.

It can also be seen from a comparison of FIGS. 9 and 10 that the width of the retaining ring 9, and thus its radial dimension, is adapted to the radial distance of the outwardly-directed or outwardly-facing surface of a contact 4, contact pin or contact socket, from the outer side 3*a* of the insulating member 3; that is, the radial width of the retaining ring 9 can be larger in the region of thinner contact pins or female contacts according to FIG. 10 than in the region of thicker contact pins or female contacts. FIG. 9 shows an arrangement with six contacts 4 in all, of about equal diameter, while FIG. 10 shows an arrangement with eight contacts in all, in which four have a smaller cross section than the others.

The preferred embodiments described hereinabove make possible, as already briefly mentioned, a favorable production of the individual parts and also a simple assembly which—briefly summarized—is generally as follows:

First the retaining ring 9 according to FIGS. 1 and 2 is snapped into the groove 8 of the insulating member 3.

After this, the contacts 4 and 41, contact pins or female contacts, which can be already provided with cables 5, are introduced with their ends later serving as the contacts into corresponding bores 6 of the insulating member 3. The retaining ring 9 is thereupon widened in the radial direction and displaced, and afterward springs into the groove-like recesses 7 of the contacts 4 when these are located in the same diametral plane as the groove 8.

The retaining spring 14 can subsequently be inserted and snapped in on the grounding contact 411 within the groove 8.

The insulating member 3, with the retaining ring 9, the retaining spring 14 and the contacts 4, 41 and 411, is then introduced into the bushing 2, formed as a metallic housing, as far as an internal stop. The retaining projection 23 of the retaining tongue 19 of the insulating member 3 springs into an undercut provided therefor, outwardly bounded by an edge 20, and preferably capable of enclosing the retaining projection 23 on both sides in the axial direction. The insulating member 3 is thereby secured in the bushing 2, whereby the retaining ring 9 and the retaining spring 14 are furthermore simultaneously secured and locked against a loosening movement, because the inner wall of the bushing 2 comes into abutment on the outer surface 3*a* of the insulating member 3 and of the retaining ring 9 which is flush with it.

At the same time, the bead or protrusion 16 which first projects beyond the diameter of the insulating member 3 abuts on the inner wall of the bushing 2 and leads to a more secure contacting of the grounding contact 411.

Dismantling is also easily possible, in that the insulating member 3 is removed again from the bushing 2, the retaining tongue 19 being deformed radially inward using a tool, and the insulating member 3 then being pushed axially out of the bushing 2. It is helpful here that the retaining tongue 19 is not provided over its entire outer surface with the retaining projection 23, so that next to the retaining projection 23 a tool can be introduced between the inner side of the bushing 2 and the retaining tongue 19.

The retaining ring 9 and the retaining spring 14 can then be taken out of the groove 8, after which the contacts 4, 41 and 411 can in their turn be pulled out again in the axial direction from the bores 6.

The plug-in connector 1 has an insulating member 3 retaining electrical contacts 4, 41, 411, for example contact pins or female contacts, in bores 6 running in the axial direction. The insulating member 3 has in its outer side 3*a* an outward-open groove 8 which intersects the holes or bores for the contacts 4 and 411 over a portion of their radial extent. A retaining ring 9 fits into the groove 8 and in the use position simultaneously engages in groove-like recesses 7 provided on the contacts 4 and thereby fixes the contacts in the axial direction. The retaining ring 9 can bear at least one further retaining tongue 10 which projects radially inward preferably in its plane, and which runs through a channel or perforation 14 of the insulating member 3 in the region of a further bore for a middle contact 41, and which engages in the use position in this recess, so that this further contact 41 located outside the ring region is also axially fixed.

What is claimed is:

1. Plug-in connector (1) comprising a bushing (2) and with an insulating member (3) arranged in the bushing (2) in a use position, and elongate contacts (4) which are fixed in holes or bores (6) located in the insulating member via projections on the contacts which engage in recesses (7), the projections extend transverse to an extension direction of the contacts (4) in the use position, the contacts or the bores (6) with the contacts (4) being located cylindrically concentric with a middle of the bushing (2) or of the insulating member and thus are located at an equal distance from an inner side of the bushing (2) or a surface **(3*a*) of the insulating member (3), a further contact (41) being arranged in an interior of the imaginary cylinder, parallel to the other contacts (4), within a hole or bore (6), wherein the insulating member (3) has at least one groove (8) that extends around the outer surface (3*a*) and opens outwardly that intersects or passes through the holes or bores (6) for the contacts (4) over a portion of a radial extent thereof on a side facing the outer surface (3*a*) of the insulating member, and the groove (8) is arranged on the insulating member (3) at a height at which the recesses (7) of the contacts (4) are located in the use position, and a latching or retaining ring (9) is provided, formed of an insulating material and extending at least over a portion of the entire circumference of the insulating member (3), that fits into the groove (8) of the insulating member (3), and simultaneously engages in the use position as a projection into the recesses (7) of the contacts (4), and the retaining ring (9) includes at least one inwardly-projecting retaining tongue (10) which in the use position engages into a channel or perforation (11) extending inwardly from the groove (8) and projects to within a recess (7) of the further contact (41) located in the interior of the cylindrical and the hole or bore (6) receiving the contact (41)**.

2. Plug-in connector according to claim 1, wherein the retaining ring (9) extends over only a portion of a circle, and includes two free ends **(9*a*) that can be moved apart elastically so that in a deformed state their spacing corresponds to a diameter of the insulating member (3) in a region of a base of the groove (8)**.

3. Plug-in connector according to claim 1, wherein the recesses (7), on the elongate contacts (4, 41) or contact pins, extend around a circumference thereof and are respectively bounded by a radially outwardly extending collar (12) that extends outwardly with respect to a contact region, and on a side remote from the recess (7) this collar (12) has a bevel or a cone shape (13) which, on insertion of the contact (4, 41) into the bore (6), contacts against the retaining ring (9) and deflects the retaining ring radially outwardly until the recess (7) of the contact (4, 41) is coincident with the groove (8) of the insulating member (3), so that the retaining ring (9) then automatically drops into the recess (7) of the contact (4, 41).

4. Plug-in connector according to claim 1, wherein one of the contacts arranged on an imaginary cylinder is provided as a grounding contact (411) and not engaged by the retaining ring (9), and the grounding contact (411) can be fixed in an axial direction by an electrically conductive retaining spring that fits into the groove (8) of the insulating member (3) and grips the grounding contact (411) with spring arms (15).

5. Plug-in connector according to claim 4, wherein the free ends **(9*a*) of the retaining ring (9) in the use position are arranged on both sides of the grounding contact (411)** and spaced apart therefrom.

6. Plug-in connector according to claim 4, wherein the retaining spring (14) for the grounding contact (411) can is formed of metal or of electrically conductive plastic, and includes on an outside thereof a bead or projection (16), which in the use position protrudes over a surface of the insulating member (3) at least by a play of the insulating member (3) with respect to the bushing (2) and/or a play of the retaining spring (14) in the groove (8) of the insulating member (3).

7. Plug-in connector according to claim 1, wherein a cross section of the retaining ring (9) generally fills a cross section of the groove (8) in the use position, or at least the radial extent or width of the retaining ring (9) corresponds to that of the groove (8), and the bushing (2) receiving the insulating member (3) accordingly fixes the use position of the retaining ring (9).

8. Plug-in connector according to claim 1, wherein the retaining tongue (10) of the retaining ring that projects radially inwardly has a concave shape at an end thereof, and thereby is at least partially adapted to a circumferential shape at a base of the recess (7) of the further contact (41).

9. Plug-in connector according to claim 1, wherein the retaining ring (9) extends around more than 180° of the insulating member (3) within the groove (8) which extends around an entire circumference of the insulating member.

10. Plug-in connector according to claim 1, wherein the free ends **(9*a*) of the retaining ring (9) are mutually beveled so that they form an insertion funnel for facilitating pushing the insulating member (3) onto or pushing into the groove (8)**.

11. Plug-in connector according to claim 1, wherein the bushing (2) enclosing the insulating member (3) is formed of metal and forms the housing of the plug-in connector (1), and includes a thread (17) on the outer side.

12. Plug-in connector according to claim 1, wherein the bushing (2) includes positioning projections or recesses on an inner side thereof, and the insulating member (3) includes deformations (18) fitting with the projections or recesses, which upon axial insertion of the insulating member (3) establish a preselected rotational position.

13. Plug-in connector according to claim 1, wherein an undercut is provided in the axial direction on an interior of the bushing, behind which undercut its at least one retaining tongue (19) fits which protrudes on the insulating member (3) in a radial direction, and is radially yieldable or can be pressed in, and is elastically resiliently pivotable.

14. Plug-in connector according to claim 13, wherein the retaining tongue (19), elastically resilient in the radial direction, is pivotable about a pivot axis parallel to the mid-axis of the insulating member (3) or of the plug-in connector (1), and extends in the circumferential direction of the insulating member (3).

15. Plug-in connector according to claim 14, wherein the elastically deformable retaining tongue (19) borders with a side face (22) on the groove (8), and bounds the groove (8), and wherein the retaining ring (9) and/or the retaining spring (14) lock the elastically resilient retaining tongue (19) in the use position against an axial deformation.

16. Plug-in connector according to claim 15, wherein the retaining tongue (19) has on its outer side a retaining projection (23) whose radial extent is equal to or smaller than a deformation path of the retaining tongue (19) in the radical direction.

17. Plug-in connector according to claim 1, wherein a width of the retaining ring (9) corresponds to a radical distance of the outwardly-facing surface of one of the respective (4) or contacts or contact pins from the outer side **(3*a*) of the insulating member (3), and the width of the retaining ring (9)** in the region of thin contact pins or females tacts is greater than in the region of thicker contact pins or female contacts.

18. Plug-in connector according to claim 1, wherein the retaining tongue (10) is located generally in the middle between the free ends **(9*a*) of the retaining ring (9) and in a common plane with a remaining course of the ring, so that it is formed on a neutral zone when the retaining ring (9)** is bent.

* * * * *